US006860049B2

(12) United States Patent
Bagnara

(10) Patent No.: US 6,860,049 B2
(45) Date of Patent: Mar. 1, 2005

(54) KEY HOLDER PENDANT

(76) Inventor: Gianluca Bagnara, Via G. Romagnoli, 72, 40050 Monte S. Pietro (IT)

( * ) Notice: Subject to any disclaimer, the term of this patent is extended or adjusted under 35 U.S.C. 154(b) by 8 days.

(21) Appl. No.: 10/363,899

(22) PCT Filed: Jul. 24, 2001

(86) PCT No.: PCT/EP01/08561

§ 371 (c)(1),
(2), (4) Date: Mar. 10, 2003

(87) PCT Pub. No.: WO02/24017

PCT Pub. Date: Mar. 28, 2002

(65) Prior Publication Data

US 2003/0167665 A1 Sep. 11, 2003

(30) Foreign Application Priority Data

Sep. 21, 2000 (IT) ..... BO20000119 U

(51) Int. Cl.[7] ..... A44B 15/00

(52) U.S. Cl. ..... 40/634; 40/330; 40/633; 63/1.11; D3/207; D3/208; D11/3; 70/456 R

(58) Field of Search ..... 40/634, 330, 633, 40/639; 63/1.11, 1.12, 21, 23, 38; D3/207, 208; D11/3, 6; 70/456 R, 460

(56) References Cited

U.S. PATENT DOCUMENTS

| | | | | | |
|---|---|---|---|---|---|
| 1,371,925 | A | * | 3/1921 | Morgenthaler | 40/633 |
| 3,113,393 | A | * | 12/1963 | Manzardo | 40/330 |
| 3,124,286 | A | | 3/1964 | Dompier | |
| 3,126,729 | A | | 3/1964 | Leopoldi | |
| 3,516,272 | A | * | 6/1970 | Modrey | D3/207 |
| 3,777,523 | A | | 12/1973 | Holland | |
| 4,133,195 | A | | 1/1979 | McLaren | |
| 6,401,488 | B1 | * | 6/2002 | Cousin et al. | 63/38 |

FOREIGN PATENT DOCUMENTS

| | | |
|---|---|---|
| FR | A-2 002 961 | 11/1969 |
| FR | A-2 433 317 | 3/1980 |

* cited by examiner

*Primary Examiner*—Gary C. Hoge
(74) *Attorney, Agent, or Firm*—Guido Modiano; Albert Josif; Daniel O'Byrne

(57) ABSTRACT

A key holder pendant, constituted by a head which is connected, by means of connecting elements, to rings which are adapted to hold keys, comprising a bent rod-like element whose mutually opposite ends form teeth which can be detachably engaged in seats provided in the head.

3 Claims, 2 Drawing Sheets

KEY HOLDER PENDANT

TECHNICAL FIELD

The present invention relates to a key holder pendant which allows to compose interchangeably, on one of the hanging elements, words and more particularly names of people, acronyms, etcetera.

BACKGROUND ART

It is known that key holder pendants are commercially available which bear words, names, etcetera on their pendant rings. However, these words are composed by printing or applying characters upon manufacture of the object; therefore once the item has been manufactured it is not possible to vary the content and meaning of the words.

DISCLOSURE OF THE INVENTION

The aim of the present invention is to obviate this drawback and to provide a key holder pendant in which the words applied to one of the pendant elements are interchangeable at will.

Within this aim, an object of the present invention is to provide a key holder pendant which is simple, relatively easy to provide in practice, safe in use, effective in operation, and relatively low in cost.

This aim and this and other objects which will become better apparent hereinafter are achieved by the present key holder pendant, constituted by a head which is connected, by means of connecting elements, to rings which are adapted to hold keys, characterized in that, it comprises a bent rod-like element whose opposite ends form teeth which can be detachably engaged in seats provided in said head.

BRIEF DESCRIPTION OF THE DRAWINGS

Further characteristics and advantages of the present invention will become better apparent from the following detailed description of a preferred but not exclusive embodiment of a key holder pendant according to the invention, illustrated only by way of non-limitative example in the accompanying drawings, wherein.

WAYS OF CARRYING OUT THE INVENTION

Figure 1:
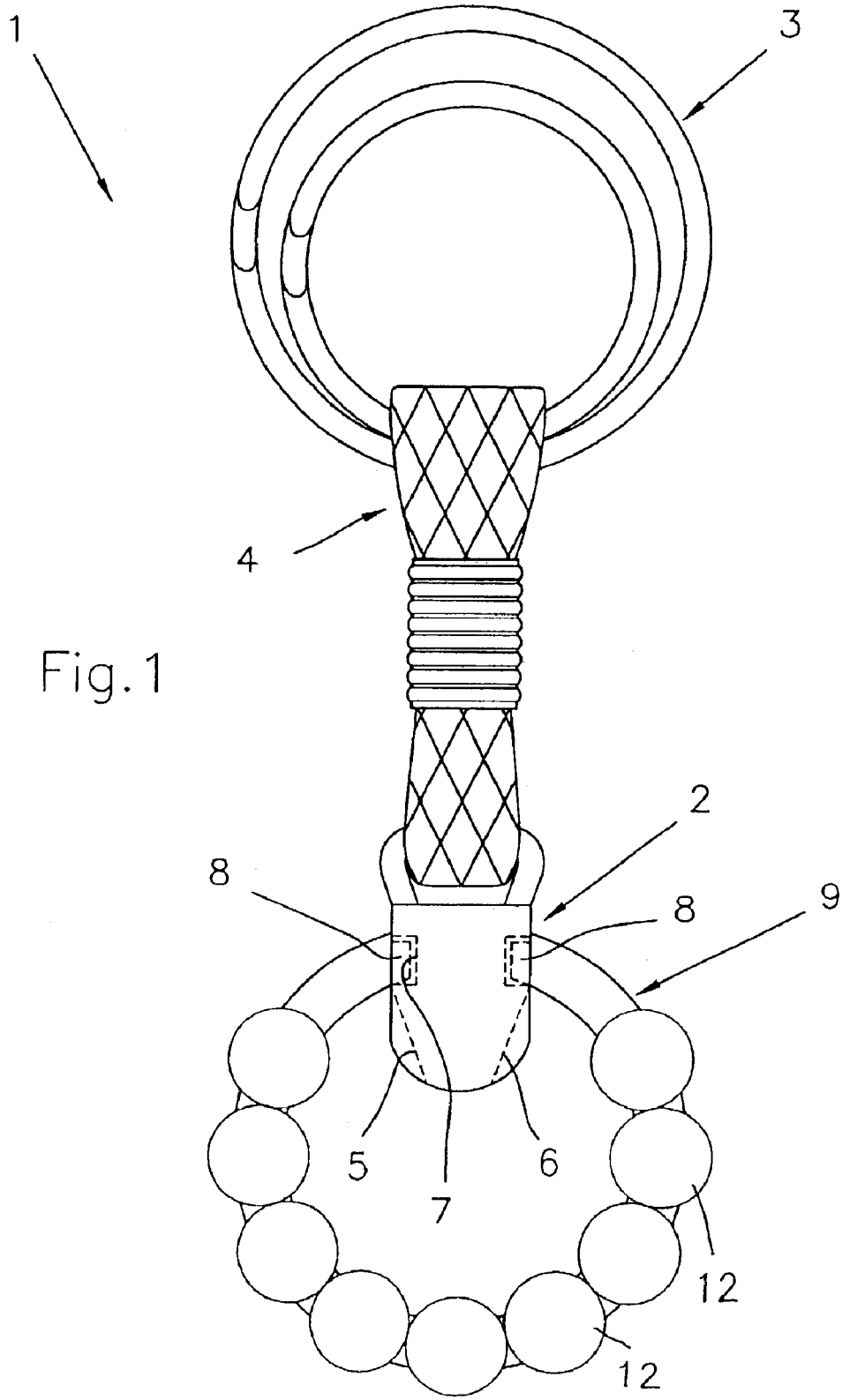
FIG. 1 is a front view of the key holder pendant according to the present invention.
Figures 2, 3:
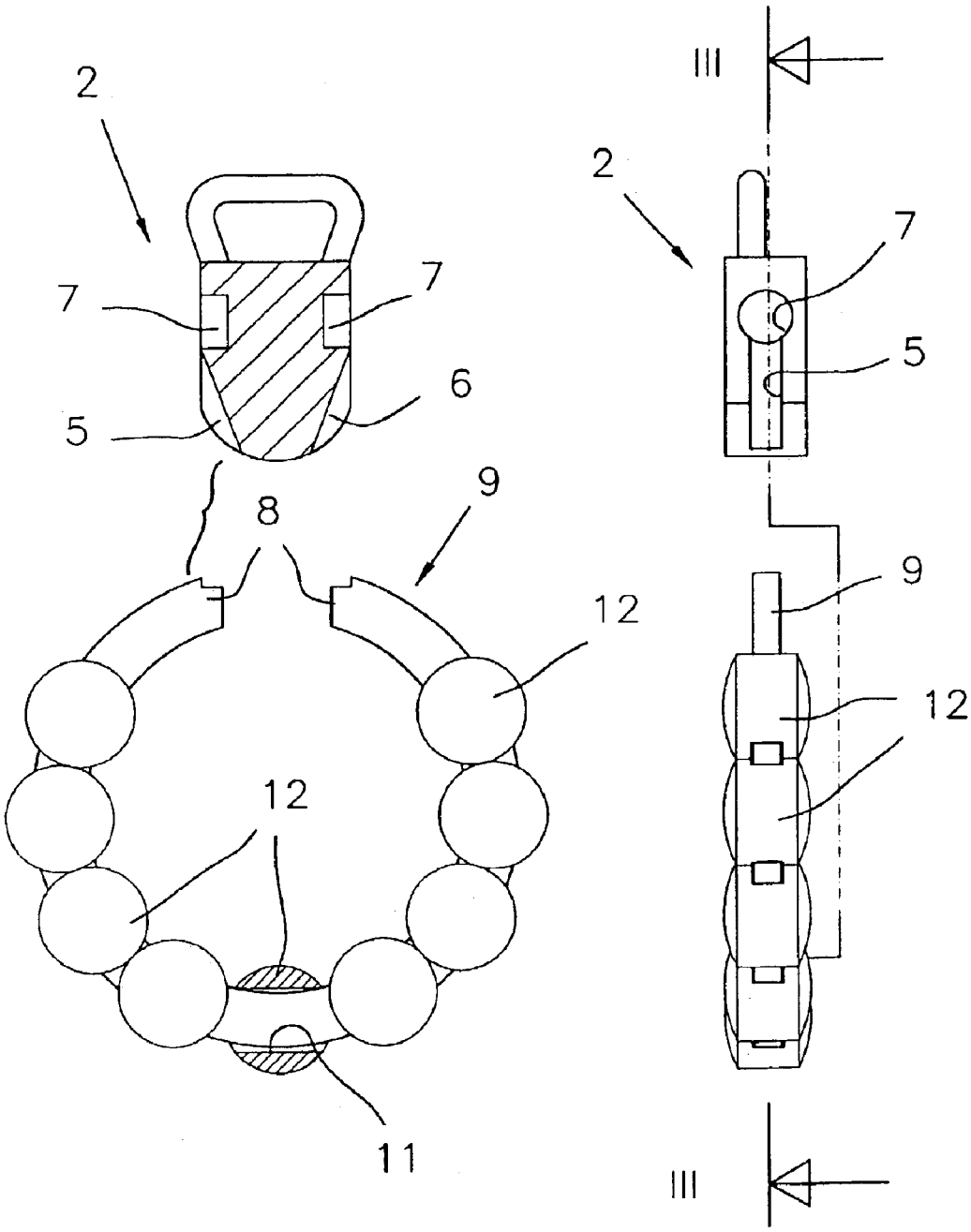
FIG. 2 is a view taken along the vertical side of the pendant.
FIG. 3 is a sectional view, taken along the line III—III of FIG. 2.

With reference to the figures, the reference numeral 1 generally designates a key holder pendant which is constituted by a head 2 and by rings 3 of commercial type which are adapted to hold actuation keys for locks and the like inserted thereon.

The rings 3 are connected to the head 2 by means of connecting elements 4. The connecting elements 4 have, in the embodiment shown in FIG. 1, a bow made of flexible material which is engaged at its opposite ends by the rings 3 and the head 2. In another embodiment, the connecting elements consist of a protrusion which protrudes from the head 2 and has holes crossed by the rings 3 adapted to hold the keys.

The head 2 is laterally provided with recesses which form guides 5 and 6 which lead into seats 7 which are engaged detachably and with an interlocking coupling by end teeth 8 of a rod-like element 9 which is bent so as to form a circle. The rod-like element 9 has a flattened rectangular cross-section which is engaged externally by a slider 11 of buttons 12 which bear alphanumeric characters on at least one face, preferably their exposed face.

The teeth 8 can rotate in the seats 7.

In practical operation, when the key holder pendant is sold, it is possible to compose words, acronyms, names of people at the buyer's choice by threading one or more buttons 12 by means of the sliders 11 along the rod-like element 9. Once the name has been composed, the teeth 8 are rested at the inlet of the pair of guides 5 and 6 and locked in the seats 7 by making them slide in the guides. At this point the pendant is complete.

It has thus been observed that the invention achieves the intended aim and object.

The invention thus conceived is susceptible of numerous modifications and variations, all of which are within the scope of the inventive concept.

All the details may further be replaced with other technically equivalent ones.

In practice, the materials used, as well as the shapes and the dimensions, may be any according to requirements without thereby abandoning the scope of the protection of the appended claims.

The disclosures in Italian Utility Model Application No. BO2000U000119 from which this application claims priority are incorporated herein by reference.

What is claimed is:

1. A key holder pendant, constituted by a head which is connected, by means of connecting elements, to rings which are adapted to hold keys, comprising a bent rod-like element whose mutually opposite ends form teeth which can be detachably engaged in seats provided in said head, wherein said teeth can rotate in said seats.

2. The pendant according to claim 1, further comprising buttons which bear characters on at least one face and are provided with a slider which engages said rod-like element so as to compose words along said rod-like element.

3. The pendant according to claim 1, wherein with lateral guides which lead into said seats so as to assist the interlocking engagement of said teeth in said seats.

* * * * *